US009562386B2

(12) United States Patent
Berman

(10) Patent No.: US 9,562,386 B2
(45) Date of Patent: Feb. 7, 2017

(54) ARMORED MODULAR SAFE SYSTEM AND METHOD

(71) Applicant: Granite Tactical Vehicles Inc., Mount Airy, NC (US)

(72) Inventor: Christopher Berman, Mount Airy, NC (US)

(73) Assignee: Granite Tactical Vehicles Inc., Mount Airy, NC (US)

( * ) Notice: Subject to any disclaimer, the term of this patent is extended or adjusted under 35 U.S.C. 154(b) by 0 days.

(21) Appl. No.: 14/964,973

(22) Filed: Dec. 10, 2015

(65) Prior Publication Data

US 2016/0168901 A1 Jun. 16, 2016

Related U.S. Application Data

(60) Provisional application No. 62/090,016, filed on Dec. 10, 2014.

(51) Int. Cl.

| | |
|---|---|
| ***E05G 1/00*** | (2006.01) |
| ***E05G 1/024*** | (2006.01) |
| ***E05G 1/026*** | (2006.01) |
| ***A47B 47/00*** | (2006.01) |
| ***A47B 87/00*** | (2006.01) |

(52) U.S. Cl.

CPC ..... *E05G 1/024* (2013.01); *A47B 47/0091* (2013.01); *A47B 87/00* (2013.01); *E05G 1/026* (2013.01)

(58) Field of Classification Search

CPC ... A47B 47/0091; A47B 47/047; A47B 47/00; A47B 47/02; A47B 45/00; A47B 87/00; A47B 87/005; A47B 87/007; E05G 1/024; E05G 1/026; E05G 1/00

See application file for complete search history.

(56) References Cited

U.S. PATENT DOCUMENTS

| | | | | |
|---|---|---|---|---|
| 4,389,948 | A * | 6/1983 | Sands | E05G 1/024 109/79 |
| 4,559,881 | A * | 12/1985 | Lankard | B28B 23/00 106/644 |
| 6,123,208 | A * | 9/2000 | Haenszel | A47B 45/00 108/55.1 |
| 7,458,305 | B1 * | 12/2008 | Horlander | F41H 5/013 109/1 S |
| 8,147,009 | B1 * | 4/2012 | Rider | A47B 47/00 312/108 |
| 8,608,262 | B1 * | 12/2013 | Daros | A47B 88/0014 312/205 |
| 2004/0083935 | A1 * | 5/2004 | Alizade | E05G 1/024 109/49.5 |
| 2015/0086260 | A1 * | 3/2015 | Turnipseed | F16B 12/44 403/205 |

* cited by examiner

*Primary Examiner* — Daniel Rohrhoff

(74) *Attorney, Agent, or Firm* — Davis Wright Tremaine LLP

(57) ABSTRACT

A modular safe system that can include a door unit and a pair of modular cap extension units that can be coupled on opposing sides of the door unit. The modular safe system can further include a corner-extension unit and a straight extension unit.

15 Claims, 5 Drawing Sheets

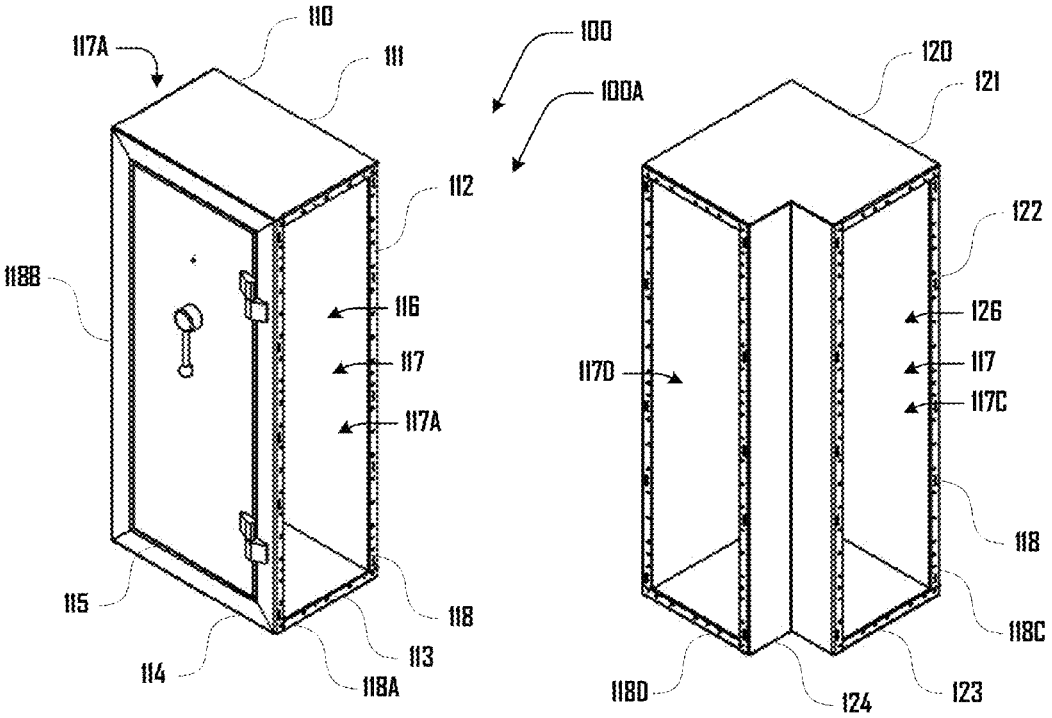
Fig.1
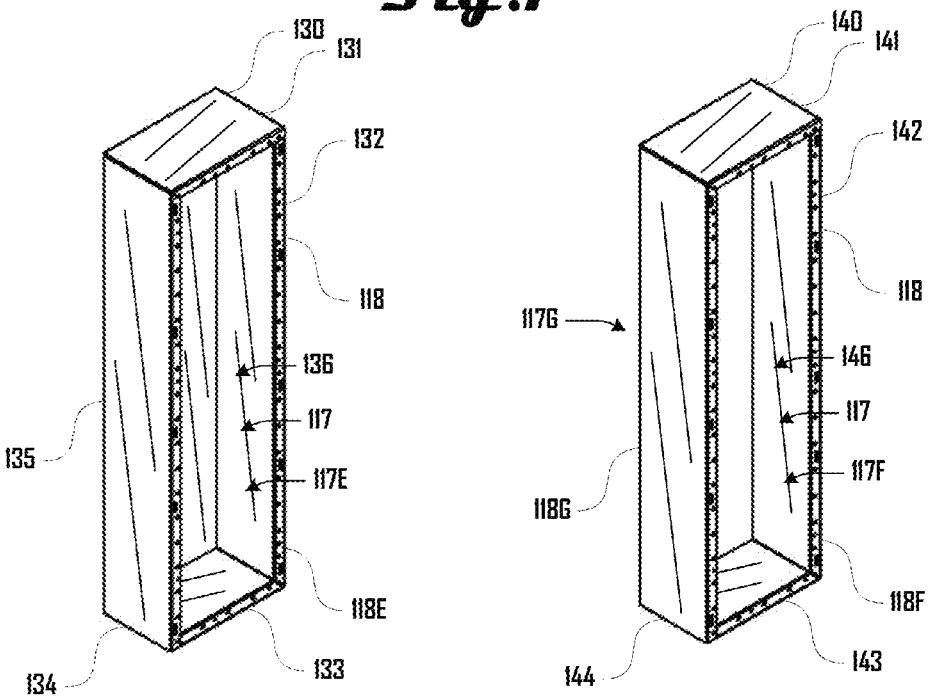

ARMORED MODULAR SAFE SYSTEM AND METHOD

CROSS-REFERENCE TO RELATED APPLICATIONS

This application is a non-provisional of, and claims the benefit of, U.S. Provisional Application No. 62/090,016, filed Dec. 10, 2014, which application is hereby incorporated herein by reference in its entirety and for all purposes.

BACKGROUND

One aspect of a safe is to secure valuable objects against theft or other unauthorized access. Safes are commonly manufactured from cast or formed steel, and with a door secured by locking pins, and with a key-operated or combination lock. The walls of the safe are normally made of carbon steel of thicknesses between 0.10 inch and 0.12 inch. Additionally, multiple layers of fire resistant gypsum boards within the steel envelope and a layer of interior material serve to further safeguard valuables.

The steel outer shell of the safe is normally constructed by fitting parts together which are then joined by welding to make a box into which is fitted a door or lid and snugly against a seal around the door frame to prevent access to the interior.

Such a single-unit safe has a drawback of needing to be of a size small enough to be moved into place and is therefore susceptible to attack by an unauthorized person simply removing the entire safe from its premises for subsequent cracking elsewhere where the thief is unconstrained by time, noise, access to cutting tools, or the like. Another drawback is that in place, conventional un-armored safes are susceptible to attack using rotating or reciprocating saw blades against the flat surfaces.

In view of the foregoing, a need exists for an improved safe system in an effort to overcome the aforementioned obstacles and deficiencies of conventional safes.

BRIEF DESCRIPTION OF THE DRAWINGS

FIG. 1 is an exemplary drawing illustrating an embodiment of a modular armored safe system that comprises a door-unit, a corner-extension unit, a cap-extension unit, and a straight-extension unit.

Figure 2A:
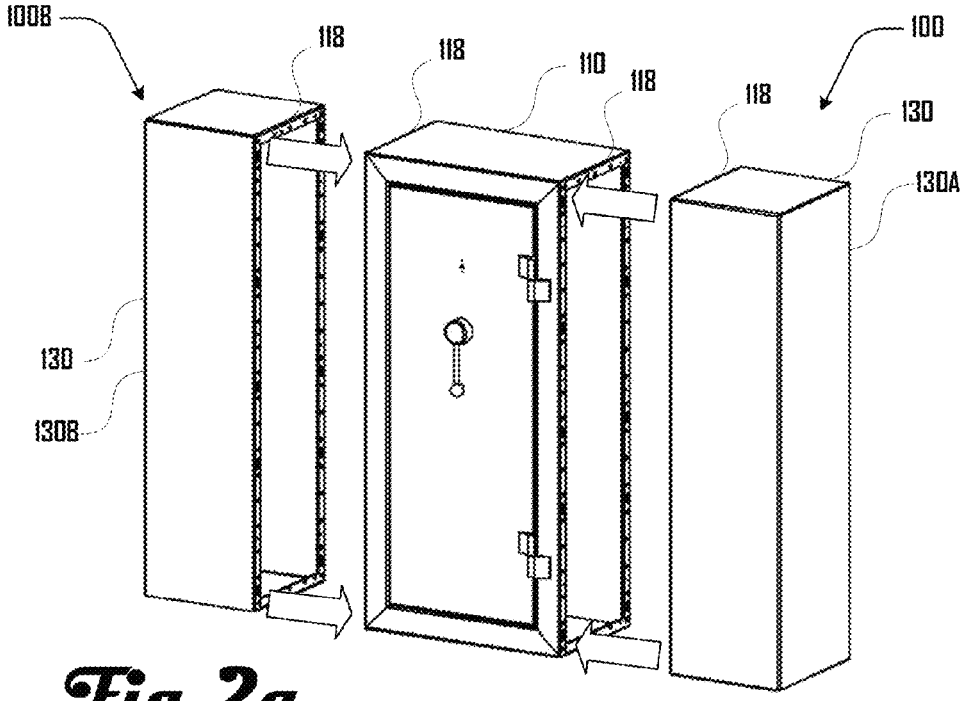
FIG. 2*a* is an exemplary perspective drawing illustrating another embodiment of a modular armored safe system that comprises a door-unit and a pair of cap-extension units.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION OF THE PREFERRED EMBODIMENTS

Since currently-available safes are deficient because they can be transported as a unit by thieves and/or provide limited protection against attack by saws, drills, pry-bars or the like, a modular armored safe system that provides for large modular and secure armored units can prove desirable and provide a basis for a wide range of applications, such as economically securing valuables in personal and commercial settings. This result can be achieved, according to one embodiment disclosed herein, by a modular armored safe system 100 as illustrated in FIG. 1.

Turning to FIG. 1, one embodiment 100A of the modular armored safe system 100 is shown as comprising a door-unit 110, a corner-extension unit 120, a cap-extension unit 130, and a straight-extension unit 140. In further embodiments, there may be any suitable plurality of any one of the door-unit 110, corner-extension unit 120, cap-extension unit 130, and straight-extension unit 140 (e.g., two, three, four, or the like) and/or any one of the door-unit 110, corner-extension unit 120, cap-extension unit 130, and straight-extension unit 140 can be absent from a modular armored safe system 100. Additionally, the embodiments of units 110, 120, 130, 140 of an armored safe system 100 should not be construed to be limiting on the wide variety of other units that are within the scope and spirit of the present invention.

The door-unit 110 comprises a top 111, rear 112, base 113, front frame 114 and door 115 that collectively define a door-cavity 116 and a pair of door-ends 118A, 118B. The door ends 118A, 118B respectively define door ports 117A, 117B. The corner-extension unit 120 comprises a top 121, back 122, base 123, and corner face 124 that collectively define a corner cavity 126 and a pair of corner-ends 118C, 118D. The corner-ends 118C, 118D respectively define corner ports 117C, 117D. The cap-extension unit 130 comprises a top 131, a rear 132, a base 133, a front 134, and a cap 135 that collectively define a cap-cavity 136 and a cap-end 118E that defines a cap port 117E. The straight-extension unit 140 comprises a top 141, a rear 142, a base 143, a front 144, that collectively define an extension-cavity 146 and extension ends 118F, 118G that define an extension ports 117F, 117G.

In various embodiments, it can be beneficial to have a plurality of units 110, 120, 130, 140 that are assembled into a larger safe assembly because the individual units can be easily transported separately by conventional means and then secured together. The assembled and secured assembly then cannot be transported via conventional means and likely cannot pass through a conventional doorway or other building passages. Moreover, the units 110, 120, 130, 140 are secured together such that they cannot be easily disassembled from the outside by an attacker. For example, structures that couple the units 110, 120, 130, 140 together may not be accessible from the outside when the selected units are coupled together. In other words, in various embodiments, once a system 100 is contiguously coupled together such that cavities 117 are not exposed, de-coupling of the units 110, 120, 130, 140 can then only occur through the door 115 of the door unit, which can provide the sole access to an internal portion of the system 100 when coupled together (except in embodiments where there are a plurality of door units 110).

Accordingly, the door 115 of the door-unit 110 can be a safe door that can be secured via any suitable mechanism, including a locking system that comprises one or more of a key, a dial, a code input pad, a biometric scanner, a finger print reader, a voice identification unit, a retinal scanner, an RFID key, or the like.

Figure 2B:
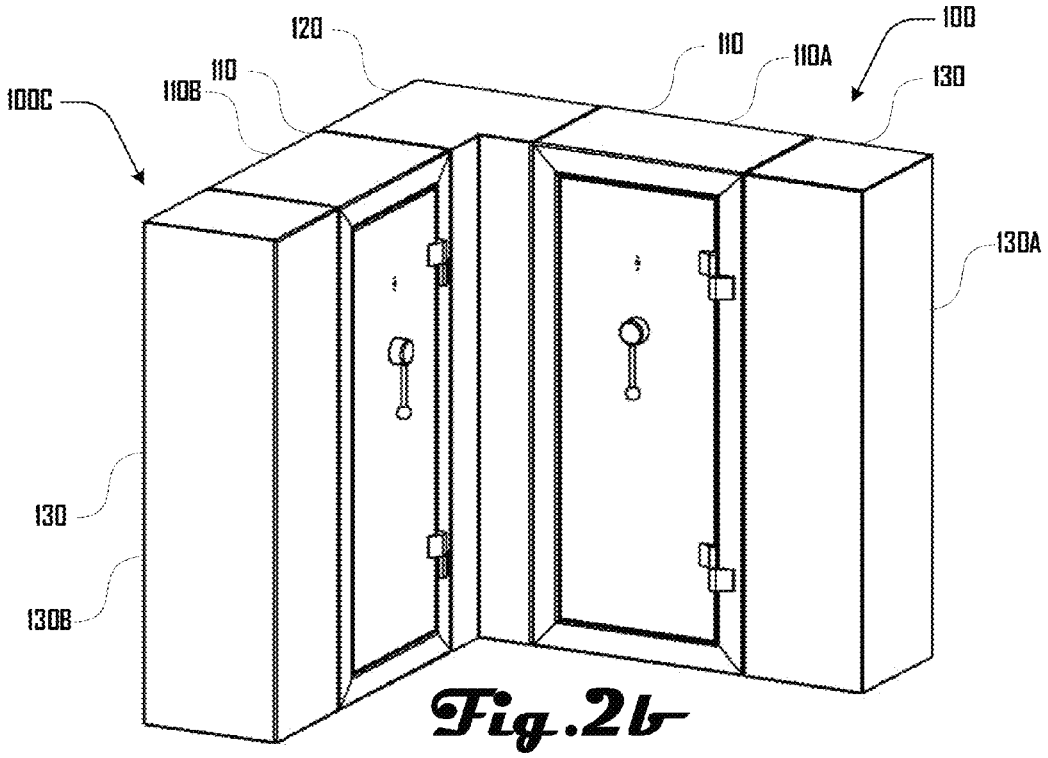
FIG. 2*b* is an exemplary perspective drawing illustrating a further embodiment of an assembled modular armored safe system that comprises a pair of door-units, a corner-extension unit, and a pair of cap-extension units.

As described in more detail herein, the ends 118 correspond to each other such that the units 110, 120, 130, 140 can be modularly coupled in any suitable or desired configuration. For example, as illustrated in FIG. 2*a*, one embodiment 100B of a system 100 can include a first and second cap-extension unit 130A, 130B that respectively couple with ends 118 of a door unit 110. Similarly, FIG. 2*b* illustrates another embodiment 110C of a system 100 that includes a pair of door units 110A, 110B respectively coupled to ends 118 of a corner-extension unit 120, with a pair of cap-extension units 130A, 130B respectively coupled to ends 118 of the door units 110A, 110B.

A modular safe system 100 that includes a plurality of units can provide additional space, but also produces a safe of greater combined weight, volume, and viewed from the top, a greater footprint, and more particularly the possibility of a shape which is not square, cubical, or even symmetrical, unlike conventional safes.

Figure 3A:
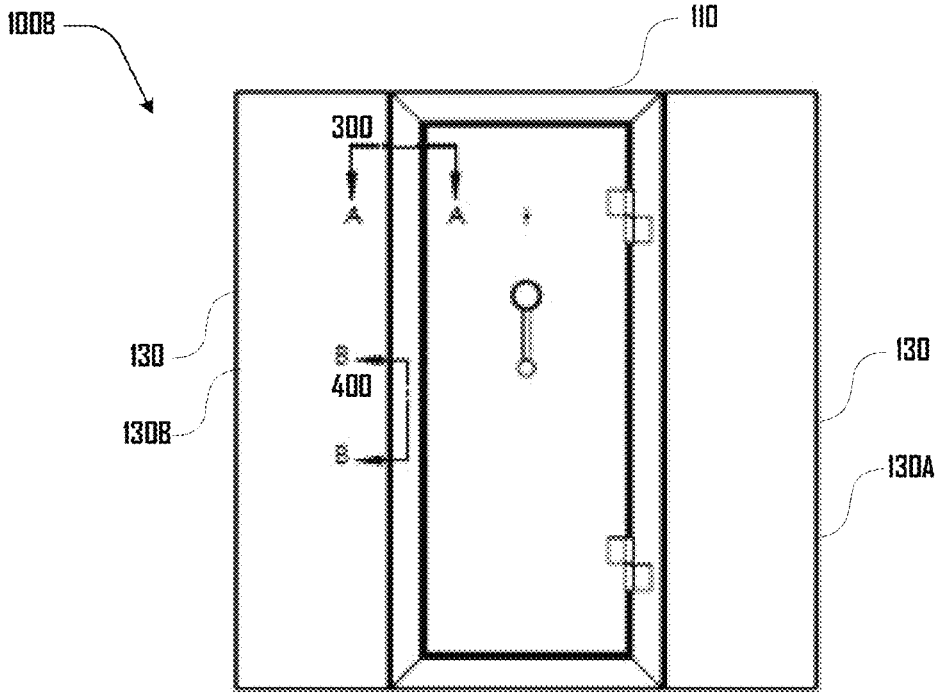
FIG. 3*a* is an exemplary front-view drawing illustrating the embodiment of a modular armored safe system of FIG. 2*a* illustrating cross-section designations.
Figure 3B:
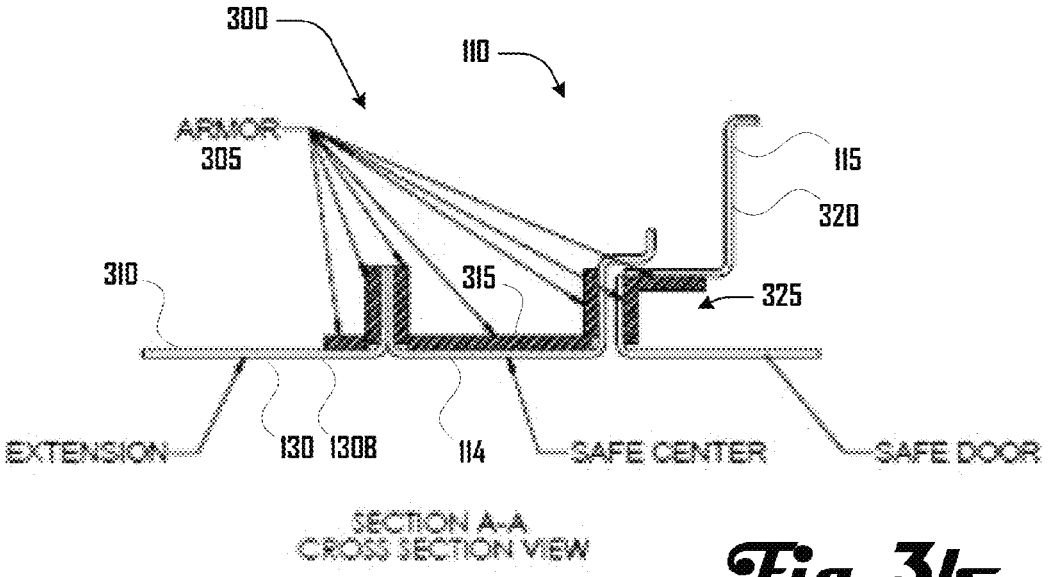
FIG. 3*b* is a first cross-section of the modular armored safe system of FIG. 2*a*.

In various embodiments, it can be beneficial to include armor plating in the units 110, 120, 130, 140 within the cavities 117. For example, FIG. 3*b* is a first cross-section A-A 300 of the modular armored safe system 100 shown in FIG. 3*a*. The cross section 300 shows a cap-extension unit 130 having armor plates 305 on an internal face of the cap-extension unit 130. Additionally, the cross section 300 also illustrates armor plates 305 on internal faces 315, 320 of the front frame 114 and door 115. As illustrated in the cross-section 300, the door 115 defines a door cavity 325 with armor plates 305 disposed within the door cavity 325.

In some embodiments it can be beneficial to provide armor plating to only a portion of the internal cavities 117 of the system. For example, it can be more economical to position armor plates or strips in positions that are more prone to attack. Additionally, it can be beneficial to position armored strips in a spaced-apart grid formation (e.g. a plurality of strips that extend both horizontally and vertically on faces within the cavities 117) and have wall of the units 110, 120, 130, 140 be made of non-armored material. For example, instead of forming the entire unit of armored or non-armored material, walls of the units 110, 120, 130, 140 be made of carbon steel, or the like, with High Hard Armor (HHA) steel strips extending vertically and/or horizontally along internal faces of the units 110, 120, 130, 140 and coupled to internal faces of the walls.

Carbon steel strength properties can include tensile strength, typically 40,000-80,000 psi, and a hardness, or Brinnell strength of BHN 120, or the like. HHA steel can be manufactured to a standard hardness of Brinnell BHN 477-534, or the like. This hardness can defeat penetration by blast and ballistic projectiles, in addition to the threat to the system 100 by pry bar, drill, or rotating or reciprocating saw blades. HHA steel can also resist bending or cutting operations in a manufacturing context, making it relatively undesirable as a material from which to construct an entire safe because it is difficult to work with.

Such a configuration having both carbon steel and armored steel, such as HHA, can prevent any successful penetration through the carbon steel walls from exceeding the grid pattern between armor strips 305. Additionally, even if armored strips 305 are detectible by ultrasonic or other non-destructive testing, the armor pattern nonetheless limits the dimensions accessible from the outside. In various embodiments patterns of armor strip grid can be uniform and/or non-uniform and sized to resist penetration to the extent economical, or if randomized across the flat surfaces of a safe (back, sides, top, bottom, door face), overcoming the additional limitations on access afforded by the armor behind the surface steel becomes unacceptably challenging and time-consuming for anyone attempting such entry. Armored strips can be parallel and/or perpendicular to the edges of the units or can be positioned in a non-parallel and perpendicular configuration.

In various embodiments, strips of armor steel 305 can be affixed to the inside faces of the cavities 117 by means of welding (e.g., plug welding through holes pre-cut in the armor strip 305 is one method) to pre-cut sheet steel prior to forming, fitting, and welding the steel parts into the safe box structure or outside surface finishing, painting, powder coating, etc., and any interior fit out, such as the adding of locks, locking pins, or interior dress such as shelves or drawers.

In various embodiments, units 110, 120, 130, 140 can be joined at respective ends 118 that surround open ports 117 of each unit 110, 120, 130, 140. For example, as shown in FIGS. 4*c* and 4*d*, ends 118 of the units 110, 120, 130, 140 and armor strips 305 respectively positioned on an internal portion of the ends 118 can include a plurality of slots 410 and bolt holes 415 along the length of the strips 305 as shown in FIG. 4*b*. Where opposing faces 118 are mated, as shown in FIG. 4*d*, bolts 420 can extend through respective bolt holes 415 to couple the respective units. Additionally, saw guards 405 can extend through corresponding slots 410 to further secure and couple the units at the faces 118.

Figure 4A:
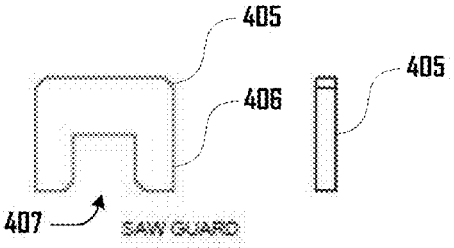
FIG. 4*a* is an exemplary front and side-view drawing illustrating an embodiment of a saw guard.
Figure 4B:
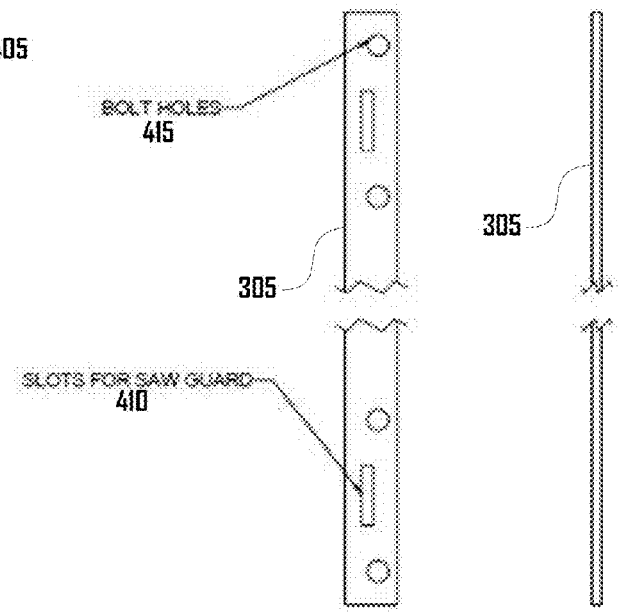
FIG. 4*b* is an exemplary front and side-view drawing illustrating an embodiment of an armored strip.
Figure 4C:
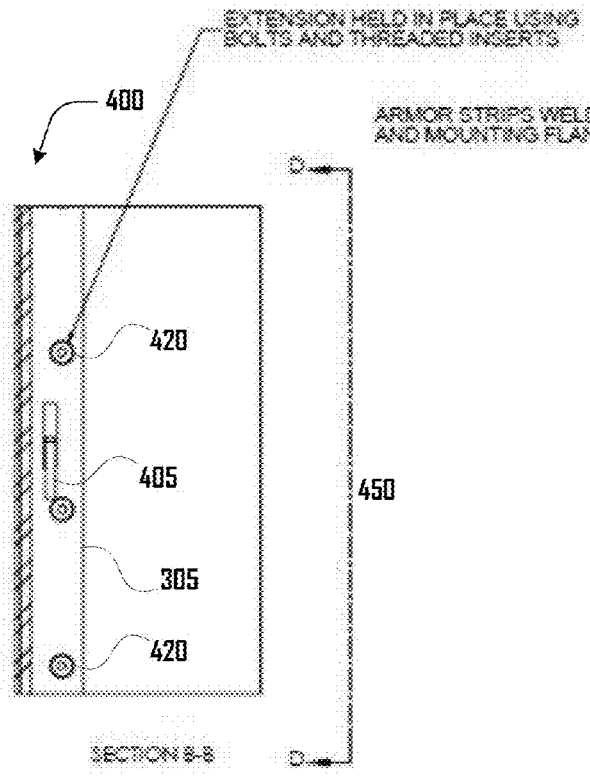
FIG. 4*c* is a first cross-section of a portion of the modular armored safe system of FIG. 2*a*.
Figure 4D:
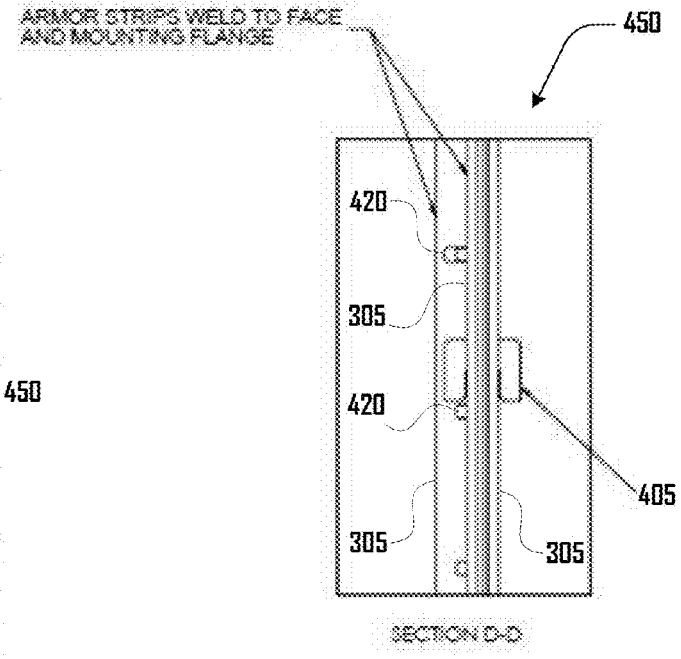
FIG. 4*d* is a first cross-section of the portion of the modular armored safe system of FIG. 4*c*.

As illustrated in FIG. 4*a*, saw guards 405 can comprise a pair of guard arms 406 that extend parallel and downward on opposing sides of a guard-slot 407. When inserted into corresponding slots 410, as shown in FIGS. 4*c* and 4*d*, a portion of the armor plates 305 and walls that define the slots 410 reside within the guard-slot 407 of saw guard 405. The guard arms 406 extend along respective portions of the armor plates 305 to further secure the units together.

Saw guards 405 can be made of armored steel such as HHA steel and can prevent decoupling of respective units 110, 120, 130, 140 even if bolts 420 or other non-armored coupling structures are cut or otherwise compromised.

Figure 5B:
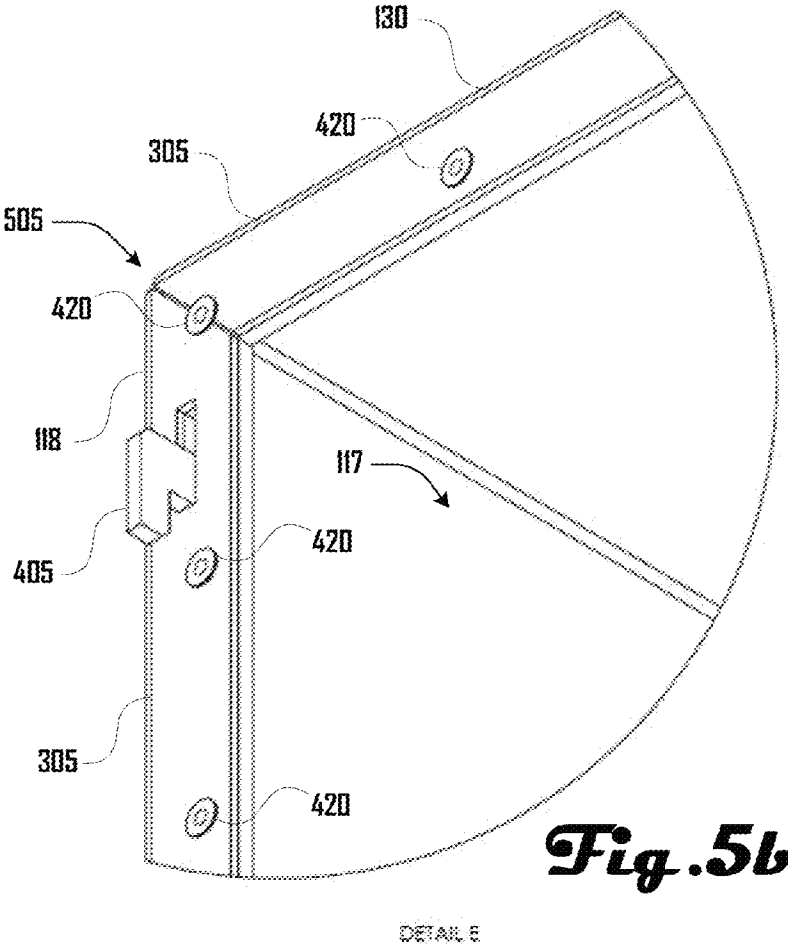
FIG. 5*b* is a detail perspective view of the cap-extension unit of FIG. 5*a*.
Figure 5A:
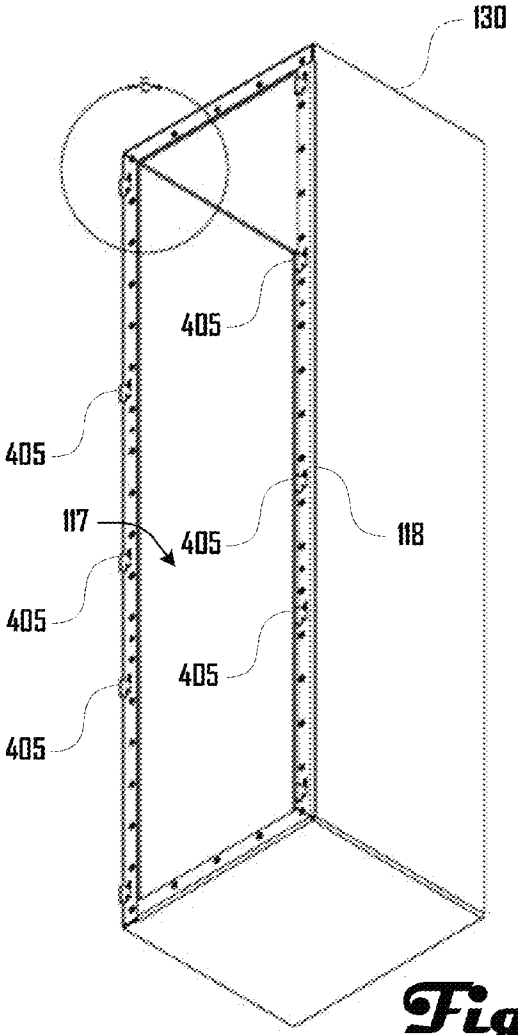
FIG. 5*a* is a perspective view of a cap-extension unit of FIG. 1 including a detail reference.

As illustrated in FIG. 5*a*, saw guards 405 can be positioned along the length of the ends 118. In various embodiments, the ends 118 can meet at corners at abutting straight edges or can meet at angled corner junctions 505 as illustrated in FIG. 5*b*. Angled corner junctions can also include a bolt 420 as illustrated in FIG. 5*b*.

The described embodiments are susceptible to various modifications and alternative forms, and specific examples thereof have been shown by way of example in the drawings and are herein described in detail. It should be understood, however, that the described embodiments are not to be limited to the particular forms or methods disclosed, but to the contrary, the present disclosure is to cover all modifications, equivalents, and alternatives.

What is claimed is:

1. A modular safe system comprising:

a first door-unit including:

a first door-unit top;

a first door-unit rear;

a first door-unit base;

a first door-unit front frame;

a first door-unit door held by the first door-unit front frame;

a first door-unit door-cavity defined by the first door-unit top, first door-unit rear, first door-unit base, first door-unit front frame, and first door-unit door; and a first and second first door-unit door-end that respectively define a first and second first door port that communicate with the first door-unit door-cavity; and a first and second cap-extension unit, each including:

a cap-extension unit top;

a cap-extension unit rear;

a cap-extension unit base;

a cap-extension unit front;

a cap-extension unit cap;

a cap-extension unit cavity defined by the cap-extension unit rear;

cap-extension unit base; cap-extension unit front; and cap-extension unit cap; and a cap-extension unit cap end that defines a cap-extension unit cap port that communicates with the cap-extension unit cavity, the cap-extension unit cap end corresponding to and configured to removably couple with either of the first and second door-unit door-ends.

2. The modular safe system of claim 1, further comprising:

a second door-unit including:

a second door-unit top;

a second door-unit rear;

a second door-unit base;

a second door-unit front frame;

a second door-unit door held by the second door-unit front frame;

a second door-unit door-cavity defined by the second door-unit top, second door-unit rear, second door-unit base, second door-unit front frame, and second door-unit door; and a first and second second door-unit door-end that respectively define a first and second second door port that communicate with the second door-unit door-cavity, the first and second second door-unit door-ends corresponding to and configured to removably couple with at least one of the cap-extension unit cap ends of the first and second cap-extension unit.

3. The modular safe system of claim 1, further comprising:

a corner-extension unit including:

a corner-extension unit top;

a corner-extension unit rear;

a corner-extension unit base;

a corner-extension unit corner face;

a corner-extension unit cavity defined by the corner-extension unit top; corner-extension unit rear; corner-extension unit base; and corner-extension unit corner face; and a first and second corner-end that respectively define a first and second corner port that communicate with the corner-extension unit cavity, the first and second corner-ends corresponding to and configured to removably couple with at least one of the cap-extension unit cap ends of the first and second cap-extension unit and at least one of the first and second first door-unit door-end of the first door-unit.

4. The modular safe system of claim 3, wherein the first and second corner-ends are disposed substantially perpendicular to each other.

5. The modular safe system of claim 1, further comprising:

a straight-extension unit including:

a straight-extension unit top;

a straight-extension unit rear;

a straight-extension unit base;

a straight-extension unit front;

an extension-cavity defined by the straight-extension unit top, straight-extension unit rear, straight-extension unit base, and straight-extension unit front; and a first and second extension end that respectively define a first and second extension port that communicate with the extension-cavity, the first and second extension ends corresponding to and configured to removably couple with at least one of the cap-extension unit cap ends of the first and second cap-extension unit and at least one of the first and second first door-unit door-end of the first door-unit.

6. The modular safe system of claim 1, further comprising armor plates disposed on internal faces of the first door unit door-cavity and the cap-extension unit cavity.

7. The modular safe system of claim 1, further comprising a plurality of armor strips disposed in a grid configuration on internal faces of the first door unit door-cavity and the cap-extension unit cavity.

8. The modular safe system of claim 7, wherein the plurality of armor strips are disposed in a spaced-apart grid formation.

9. The modular safe system of claim 1, wherein the first and second cap-extension units are removably mated to the first door-unit at a respective one of the first and second first door-unit door-end via opposing faces.

10. The modular safe system of claim 9, further comprising armor strips disposed behind each of the opposing faces.

11. The modular safe system of claim 9, wherein the first and second cap-extension units are removably mated to the first door-unit via a plurality of bolts that extend through and secure the opposing faces together.

12. The modular safe system of claim 11, wherein the first and second cap-extension units are further removably mated to the first door-unit via a plurality of saw guards that extend through respective slots defined by the opposing faces.

13. The modular safe system of claim 12, wherein the saw guards are U-shaped and each comprise a pair of guard arms that extend downward on opposing side of a guard slot.

14. The modular safe system of claim 1, wherein the first door-unit door defines a door cavity and wherein armor plates are disposed within the door cavity.

15. The modular safe system of claim 1 wherein the first and second cap-extension units and the first door-unit define a cuboid shape.

* * * * *